United States Patent [19]

Bucher, Sr. et al.

[11] Patent Number: 4,850,799

[45] Date of Patent: Jul. 25, 1989

[54] RUBBER FLYWHEEL FOR CEILING FANS

[75] Inventors: John C. Bucher, Sr., Coral Springs; Shih T. Wu, Lighthouse Point, both of Fla.

[73] Assignee: Chien Luen Industries Co., Ltd., Inc., Ft. Lauderdale, Fla.

[21] Appl. No.: 306,090

[22] Filed: Feb. 6, 1989

[51] Int. Cl.[4] ..... F04D 29/64

[52] U.S. Cl. ..... 416/134 R; 416/5; 416/170 R; 416/60

[58] Field of Search ..... 416/5, 134 R, 170 C, 416/60

[56] References Cited

U.S. PATENT DOCUMENTS

| | | | |
|---|---|---|---|
| 1,935,314 | 11/1933 | Finch et al. | 416/5 |
| 2,023,111 | 12/1935 | Alsing | 416/134 R X |
| 2,678,104 | 5/1954 | Davis | 416/134 R |
| 2,680,559 | 6/1954 | Morrill | 416/170 C X |
| 4,511,310 | 4/1985 | Pearce | 416/134 R |
| 4,621,977 | 11/1986 | Markwardt | 416/5 |
| 4,720,241 | 1/1988 | Markwardt | 416/5 |

FOREIGN PATENT DOCUMENTS

| | | | |
|---|---|---|---|
| 759535 | 1/1953 | Fed. Rep. of Germany | 416/134 R |
| 333475 | 12/1935 | Italy | 416/5 |
| 203814 | 9/1923 | United Kingdom | 416/134 R |

*Primary Examiner*—Everette A. Powell, Jr.

*Attorney, Agent, or Firm*—Dominik, Stein, Saccocio, Reese, Colitz & Van Der Wall

[57] ABSTRACT

A vibration damper for a suspended ceiling fan comprising a motor mounting and a frame support plate, totally enclosed in a vibration absorbing rubber compound. The motor mounting and frame support plates are separated by an annular space that forms an outward facing annular channel. Trapezoidal shaped reinforcement ribs located in the outward facing annular channel restrict swaying of the fan blades when the motor is energized. The damper may comprise two arcuate shaped members which allows easy installation on existing ceiling fans and easy disassembly when the fan motor needs maintenance or repairs.

12 Claims, 2 Drawing Sheets

RUBBER FLYWHEEL FOR CEILING FANS

BACKGROUND OF THE INVENTION

1. Field of the Invention

This invention relates to ceiling fans. More particularly, this invention relates to vibration dampers for ceiling fans.

2. Description of the Background Art

Motor driven fans suspended from the ceiling were used extensively in homes in the United States to provide air circulation before the introduction and popularization of central cooling units.

When the energy crisis dawned in the 1970's, the cost of a kilowatt hour sky rocketed in price and consumers searched for ways to reduce their heating and cooling costs. It has been well established that properly circulated air will raise the overall thermal efficiency of the home air conditioning and cooling system and hence, reduce the cost of maintaining a home at a desired comfort level year round. Thus, ceiling fans were repopularized in the 1970's.

Mass produced, low cost ceiling fans have several disadvantages that must be tolerated in return for savings in energy. The lower cost fans are typically noisy and vibrate excessively and the blades visibly sway. The noise and vibration are largely caused by pulsating torques common to all single phase AC motors.

Ceiling fans typically comprise a plurality of fan blades which are rigidly connected to the rotor of an electric motor by means of fan blade brackets integrally formed with or threadably fastened to the blades. In some ceiling fans, the inner rotor rotates within the outer stator of the electric motor as exemplified in U.S. Pat. No. 1,935,314. In other types of ceiling fans, commonly known as "spinner" fans, the rotor constitutes the outer housing of the fan and rotates about the inner stator. U.S. Pat. Nos. 4,621,977 and 4,720,241 disclose such spinner-type fans.

Previous attempts to reduce the noise and vibration originally focused on placing elastomeric grommets about the threaded fasteners which innerconnect the fan blades to their respective fan blade brackets. Similar attempts have also focused on attaching all of the fan blade brackets to a mounting ring and then threadably securing the mounting ring to the rotor through the use of threaded fasteners positioned through elastomeric grommets. U.S. Pat. No. 4,511,310, the disclosure of which is hereby incorporated by reference herein, illustrates the latter embodiment. In both embodiments, the threaded fastener comprises a bolt having a shank portion greater in length than the thickness of the grommet such that the shank prevents compression of the grommet upon tightening of the bolt. Thus, the grommet is freely suspended between the head of the bolt and the rotor.

The use of elastomeric grommets between the fan blades and the fan blade brackets or between the rotor and a mounting ring to which the fan blades are rigidly connected, have both been favorably accepted in the industry. Notwithstanding, the fan blades may "wobble" since the resiliency provided by the freely suspended elastomeric grommets is essentially the same for torsional, axial, and radial forces.

Therefore, it is an object of this invention to provide an apparatus which overcomes the aforementioned inadequacies of the prior art devices and provides an improvement which is a significant contribution to the advancement of the ceiling fan vibration damper art.

Another object of this invention is to provide a vibration damper for ceiling and other fans which provides torsional damping to dampen the pulsating torque created by single phase electric motors.

Another object of this invention is to provide a vibration damper for ceiling and other fans for torsionally damping pulsating torques while minimizing radial and axial movements.

Another object of this invention is to provide a vibration damper for ceiling and other fans which may be easily incorporated in existing fan constructions during the manufacture thereof.

Another object of this invention is to provide a vibration damper for ceiling fans which may be easily retrofitted to existing fans upon removal of the fan blades and brackets.

Another object of this invention is to provide a vibration damper for ceiling and other fans which does not adversely effect the aesthetic appearance of the fan.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a vibration damper for ceiling and other fans. More particularly, the vibration damper of the invention interconnects the fan blade brackets with the rotor of the motor to dampen the pulsating vibrations caused by the electric motor thereby minimizing such vibrations from being transmitted to the fan blades.

The vibration damper of the invention comprises a motor mounting plate and a fan blade frame support plate composed of a rigid material such as steel, molded insitu, within an elastomeric material. The motor mounting plate and frame support plate each comprise a ring-shaped configuration; alternatively, the motor mounting plate and frame support plate each comprise a plurality of arcuate sections that form a ring-shaped configuration when installed. The motor mounting plate and frame support plate are embedded, insitu, in a spaced-apart configuration within the injection molded elastomeric material such that an outwardly facing annular channel is formed about the outer periphery thereof between the motor mounting plate and the frame support plate. A plurality of reinforcement ribs are radially formed within the channel during the injection molding of the elastomeric material.

During installation, the motor mounting plate is rigidly fastened to the rotor through the use of threaded fasteners which are polsitioned through large size access openings in the frame support plate. The fan blade frames are then rigidly connected to the frame support plate by means of threaded fasteners which threadably engage threaded holes in the frame support plate. The frame support plate includes an aperture spacing pattern to allow threadable engagement with ceiling fans having either four fan blades or five fan blades.

An important feature of the invention is the use of a motor mounting plate and a frame support plate embedded within the elastomeric material which minimizes radial and axial movement of the fan blade frames relative to the rotor thereby minimizing drooping or swaying of the fan blades during use. However, the use of such spaced-apart plates still provides damping of torsional vibrations typically caused by pulsating AC motors. Thus, a substantial improvement over prior art elastomeric grommets is achieved.

Still another feature of the vibration damper of the invention is the ability to manufacture the vibration damper in sections, such as semicircular sections, which can be individually mounted to the rotor without removal of the lighting fixture or its switch cup commonly found on most ceiling fans. Retrofitting of the vibration damper to existing ceiling fans is therefore easily achieved.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
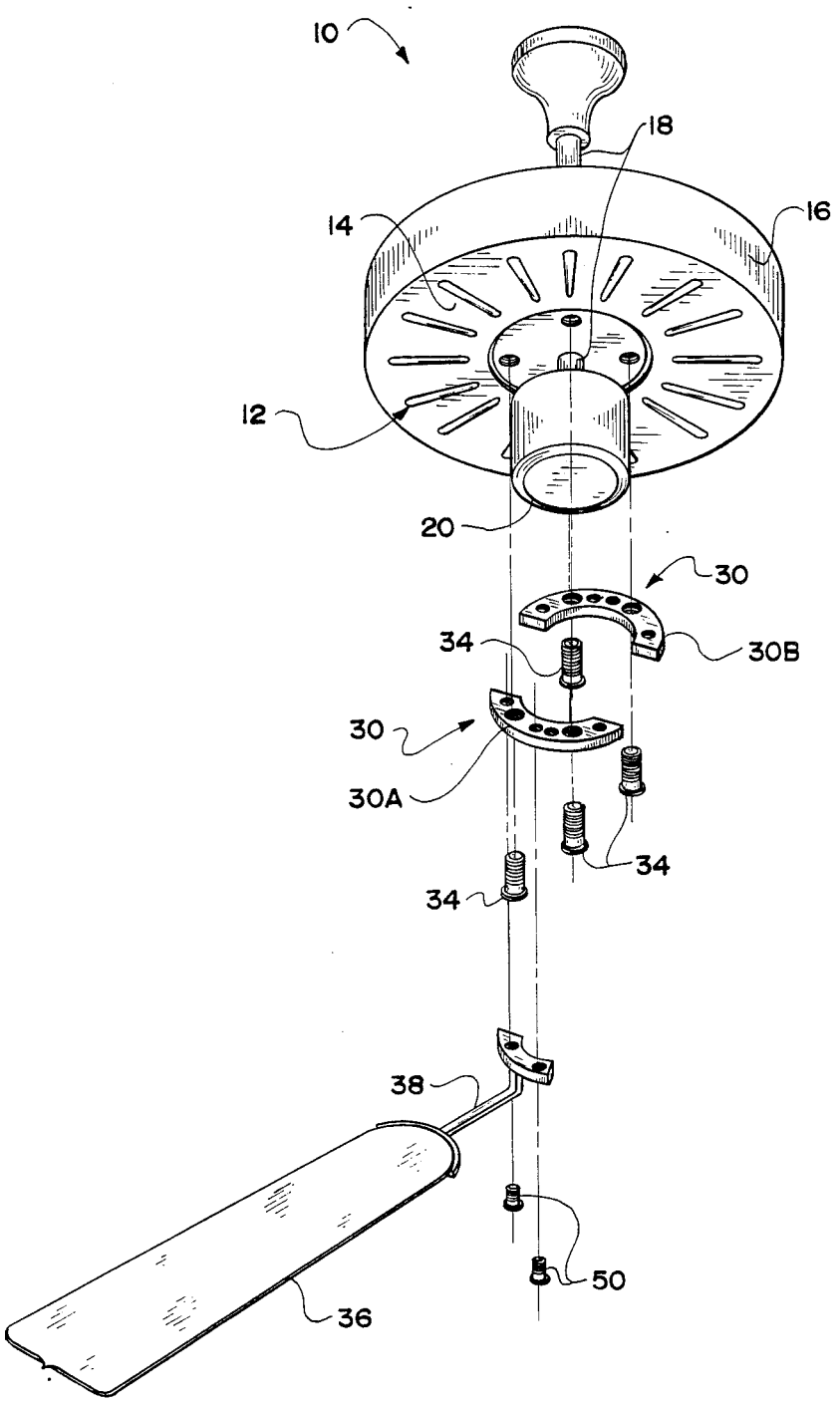
FIG. 1 is an exploded view of a typical ceiling fan showing the manner in which the vibration damper of the invention innerconnects the fan blade frames to the rotor of the electric motor.

FIG. 1 is an isometric view of a ceiling suspension fan 10 showing a motor 12 with a motor rotor 14 contained in a motor housing 16. A motor shaft 18 connects the motor 12 with a switch cup 20. The invention comprises a damper assembly 30 having two arcuate shaped members 30A and 30B forming an annular ring to facilitate the attachment to the motor rotor 14 by means of fasteners 34 (See FIG. 2). It is contemplated that the damper assembly 30 may be constructed of three or more arcuate shaped members. The damper assembly 30 being comprised of arcuate shaped multiple members 30A and 30B allows existing ceiling suspension fans to be modified without removal of the switch cup 20. Additionally, the damper assembly 30 can be removed easily for maintenance of the motor shaft 18 or the motor 12. The fan blades 36 are attached by fan blade frames 38 to the damper assembly 30 by means of fasteners 50.

Figure 3:
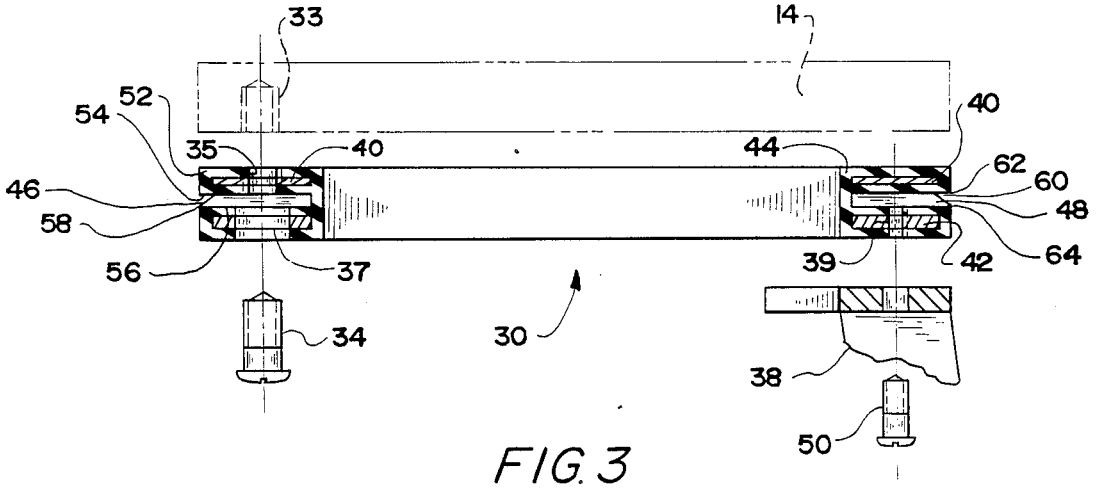
FIG. 3 is a cross-sectional view of FIG. 2 along lines 3—3 illustrating the manner in which the motor mounting plate of the damper is threadably connected to the motor and the manner in which the fan blade frames are threadably secured to the fan blade frame support plate of the damper.

FIG. 3 shows the cross-section of the damper assembly 30. The arcuate shaped members 30A and 30B each comprise a rigid motor mounting plate 40 and a rigid frame support plate 42 molded insitu in an elastomeric coating 44. The elastomeric coating 44 is designed to absorb the vibrations generated by the motor 12 and not allow the motor 12 vibration to propagate to the fan blade frame 38 and the fan blade 36.

The imbedded, motor mounting plate 40 and imbedded, frame support plate 42 provide the tensile strength required to support the weight of the fan blade frame 38 and the fan blade 36 with minimal deflection of the fan blade 36. The motor mounting plate 40 and the frame support plate 42 are separated by an annular space that forms an outward facing annular channel 46. A plurality of trapezoidal shaped reinforcement ribs 48 are positioned in the outward facing annular channel 46 to overcome the swaying of the fan blade frame 38 and the fan blade 36 when rotating and maintain the normal angle of the fan blade 36. The trapezoidal shaped reinforcement ribs 48 are spaced equidistantly within the outward facing annular channel 46.

The trapezoidal ribs 48 comprise a shorter top face 52 molded radially to a bottom side 54 of the motor mounting plate 40; and a longer lower face 56 molded radially to a top side 58 of the frame support plate 42. Thus, a trapezoidal face 60 slopes along an axis in the outward facing annular channel 46 from an outermost edge 62 of the shorter top face 52 to an outermost edge 64 of the longer lower face 56.

This arrangement of the trapezoidal ribs 48 contributes the resiliency of the trapezoidal ribs 48 to the total vibration absorption capacity of the damper assembly 30 by connecting in a less than rigid manner, the motor mounting plate 40 to the frame support plate 42.

The motor mounting plate 40 of the damper assembly 30 is attached to the motor rotor 14 of the motor 12 with fasteners 34 that threadably engage mounting holes 33 in the motor rotor 14 through apertures 35 in the rigid motor mounting plate 40. Access apreatures 37 are provided in alignment with aperature 35 to provide access thereto. The fan blade frames 38 are attached to the frame support plate 42 via threaded aperatures 39 and fasteners 50.

Figure 2:
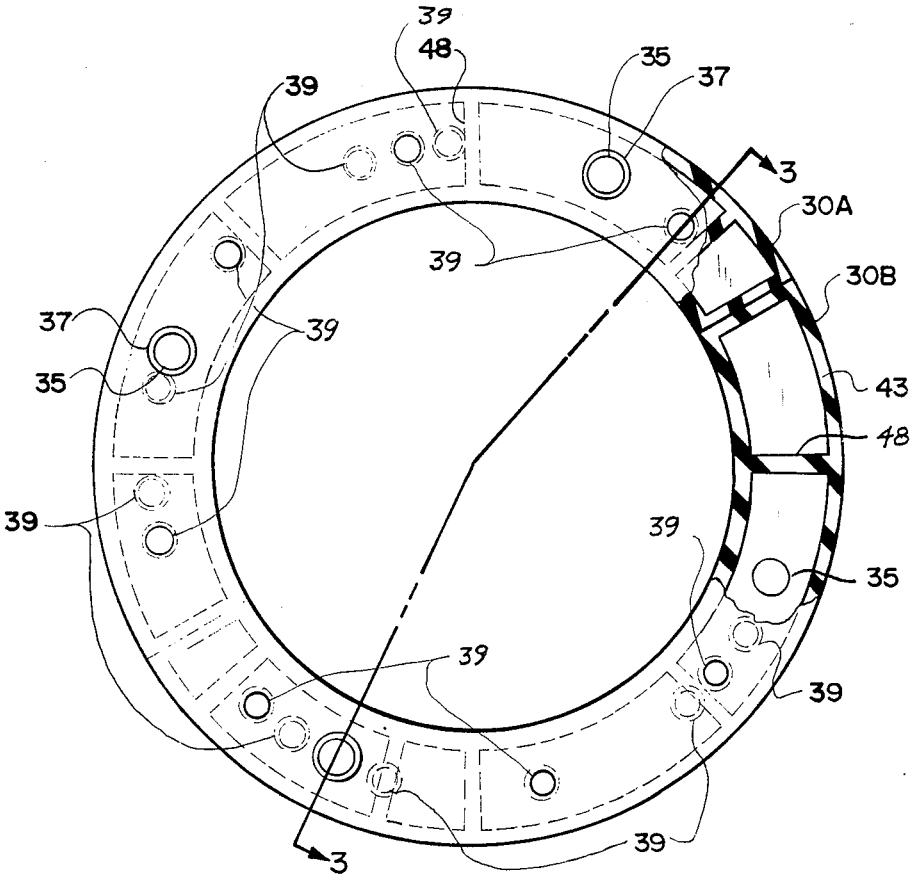
FIG. 2 is a bottom plan view of the vibration damper of the invention, partially cut-away, illustrating the hole pattern for mounting the damper to the rotor of the electric motor and for mounting the four or five fan blade frames to the damper.

Referring to FIG. 2, the rigid frame support plate 42 may have paired apertures 39 spaced for allowing adaptation to either a four blade ceiling fan configuration (as shown) or a five blade ceiling fan configuration. This features allows a ceiling fan manufacturer to merely punch out the desired hole configuration (four blade or five blade fan) through the elastomeric coating 44 in alignment with apertures 39. Then, the apertures 39 are tapped for threadable engagement of the frame support plate 42 with fasteners 50.

During operation, the motor mounting plate 40 absorbs the initial surge of vibration from the motor 12; the trapezodial ribs 48 absorb an additional portion of the unabsorbed vibration that passes through the motor mounting plate 40; and the frame support plate 42 absorbs the balance of the unabsorbed vibration that passes through the trapezoidal ribs 48.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

What is claimed is:

1. A ceiling fan comprising in combination:

a plurality of fan blades each attached to a frame;

motorized means for rotating said plurality of fan blades;

a vibration damper mounted between said motorized means and said plurality of fan blade frames for absorbing vibrations and noises originating in said motorized means, said vibration damper further comprising a rigid motor mounting plate and a rigid frame support plate molded insitu, within an elastomeric material, in a substantially parallel, coplanar spaced-apart configuration;

first means for attaching said motor mounting plate to said rotation means; and second means for attaching said plurality of frames to said frame support plate.

2. The ceiling fan as set forth in claim 1, wherein said parallel, coplaner, spaced-apart configuration of said motor mounting plate and said frame support plate forms a continuous, outwardly facing annular channel.

3. The ceiling fan as set forth in claim 2, wherein said annular channel further comprises a plurality of elastomeric reinforcement ribs positioned radially between said motor mounting plate and said frame support plate.

4. The ceiling fan as set forth in claim 3, wherein said elastomeric reinforcement ribs are each trapezoidal shaped and spaced equidistantly within said annular channel.

5. The ceiling fan as set forth in claim 4, wherein said elastomeric, trapezodial shaped reinforcement ribs each comprises a shorter face located radially on a bottom surface of said motor mounting plate and a longer face located radially on a top surface of said frame support plate.

6. The ceiling fan as set forth in claim 2, wherein said vibration damper comprises a plurality of arcuate shaped members attached to said motorized means thereby forming an annular ring when fully assembled, for allowing disassembly of said vibration damper for routine maintenance and repair of said motor means without disassembly of said ceiling fan.

7. A vibration damper for minimizing motor-generated vibrations originating in a motor in a ceiling fan from reaching a plurality of fan blades, each including a frame, rotated by said motor, comprising in combination:

a rigid frame support plate having first apertures and tapped second apertures;

a rigid motor mounting plate having third apertures, said motor mounting plate and said frame support plate being enclosed within an elastomeric material in a parallel, coplanar, spaced-apart configuration with said first apertures in fastener receiving alignment with said third apertures;

first fasteners for attaching said motor mounting plate through said first and third apertures to said motor;

second fasteners for attaching said plurality of frames to said frame support plate through said second apertures.

8. The vibration damper as set forth in claim 7 wherein said parallel, coplanar, spaced-apart configuration of said motor mounting plate and said frame support plate forms a continuous, outwardly facing annular channel.

9. The vibration damper as set forth in claim 8 wherein said annular channel further includes a plurality of elastomeric reinforcement ribs positioned radially between said motor mounting plate and said frame support plate.

10. The vibration damper as set forth in claim 9, wherein said reinforcement ribs are trapezodial shaped, and spaced equidistantly within said annular channel.

11. The vibration damper as set forth in claim 10, wherein said reinforcement ribs have a shorter face located radially on a bottom surface of said motor mounting plate and a longer face located radially on a top surface of said frame support plate.

12. The vibration damper as set forth in claim 7, wherein said parallel, co-planer, spaced-apart configuration comprises a plurality of arcuate shaped members for forming an annular ring when assembled to said motor, thereby facilitating retrofitting of each said arcuate member to said motor of said ceiling fan without disassembly of said motor.

* * * * *